US009126435B2

(12) United States Patent
Sekimoto et al.

(10) Patent No.: US 9,126,435 B2
(45) Date of Patent: Sep. 8, 2015

(54) IMAGE FORMING APPARATUS

(71) Applicant: FUJI XEROX CO., LTD., Tokyo (JP)

(72) Inventors: Masahiko Sekimoto, Kanagawa (JP); Toshinobu Hamazaki, Kanagawa (JP); Satoshi Hasebe, Kanagawa (JP); Hirotake Sasaki, Kanagawa (JP); Motoharu Nakao, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/257,046

(22) Filed: Apr. 21, 2014

(65) Prior Publication Data

US 2015/0109391 A1 Apr. 23, 2015

(30) Foreign Application Priority Data

Oct. 17, 2013 (JP) ..... 2013-216750

(51) Int. Cl.
*B41J 2/01* (2006.01)
*B41J 11/00* (2006.01)

(52) U.S. Cl.
CPC ..... *B41J 11/002* (2013.01)

(58) Field of Classification Search
CPC ..... B41J 11/002; B41J 11/0015; B41J 2/01; B41M 7/0072; C09D 11/101
USPC ..... 347/102
See application file for complete search history.

(56) References Cited

U.S. PATENT DOCUMENTS

| | | | | |
|---|---|---|---|---|
| 4,595,279 | A * | 6/1986 | Kuru et al. | 399/45 |
| 2003/0189628 | A1* | 10/2003 | Kaga et al. | 347/102 |
| 2009/0295894 | A1* | 12/2009 | Hori | 347/102 |
| 2013/0033549 | A1* | 2/2013 | Barton et al. | 347/84 |
| 2013/0293646 | A1* | 11/2013 | Stephens et al. | 347/102 |

FOREIGN PATENT DOCUMENTS

| | | |
|---|---|---|
| JP | 10-193721 | 7/1998 |
| JP | 2008-110554 | 5/2008 |
| JP | 2012-25042 | 2/2012 |

OTHER PUBLICATIONS

Abstract and machine translation of JP 2008-110554.
Abstract and machine translation of JP 2012-025042.
Abstract and machine translation of JP 10-193721.

* cited by examiner

*Primary Examiner* — Manish S Shah
*Assistant Examiner* — Yaovi Ameh
(74) *Attorney, Agent, or Firm* — Fildes & Outland, P.C.

(57) ABSTRACT

An image forming apparatus includes: a conveying device that conveys a recording medium; a droplets ejecting device that ejects droplets onto the recording medium being conveyed by the conveying device; a drying unit that dries the droplets that have been ejected on the recording medium being conveyed by the conveying device; and a varying unit that varies a conveyance path length from the droplets ejecting device to the drying unit in accordance with at least one of a conveyance speed of the recording medium and an ejected droplets permeation characteristic of the recording medium.

2 Claims, 11 Drawing Sheets

FIG. 11

| TYPE | FEATURES | PERMEATION SPEED (PERMEATION CHARACTERISTIC) | CONVEYANCE PATH LENGTH |
|---|---|---|---|
| PLAIN PAPER | FOR GENERAL USE | STANDARD (SETTING: 0 (REFERENCE)) | STANDARD |
| GLOSSY PAPER | GLOSSY, FOR HIGH-RESOLUTION, HIGH REPRODUCIBILITY PRINTING | HIGHER THAN STANDARD (SETTING: +1) | SHOULD BE SET SHORTER THAN STANDARD |
| THICK MATTE PAPER | LESS GLOSSY THAN COATED SHEET FOR HIGH-RESOLUTION, HIGH REPRODUCIBILITY PRINTING | MUCH HIGHER THAN STANDARD (SETTING: +2) | SHOULD BE SET MUCH SHORTER THAN STANDARD |
| YOPO PAPER (SYNTHETIC PAPER) | RESISTANT TO WATER AND OIL AND HARD TO BREAK | LOWER THAN STANDARD (SETTING: -1) | SHOULD BE SET GREATER THAN STANDARD |
| THICK JAPANESE PAPER | VERY THICK JAPANESE PAPER THAT ENABLE DOUBLE-SIDED PRINTING | MUCH LOWER THAN STANDARD (SETTING: -2) | SHOULD BE SET MUCH GREATER THAN STANDARD |
| COATED PAPER FOR PRINTING AND PUBLISHING | COATED WITH WHITE PIGMENT, ETC. | MUCH LOWER THAN STANDARD (SETTING: -2) | SHOULD BE SET MUCH GREATER THAN STANDARD |
| NEWSPAPER | VERY THIN NEWSPAPER | MUCH HIGHER THAN STANDARD (SETTING: +2) | SHOULD BE SET MUCH SHORTER THAN STANDARD |

IMAGE FORMING APPARATUS

CROSS-REFERENCE TO RELATED APPLICATIONS

This application is based on and claims priority under 35 USC 119 from Japanese Patent Application No. 2013-216750 filed on Oct. 17, 2013.

BACKGROUND

Technical Field

The present invention relates to an image forming apparatus.

SUMMARY

According to an aspect of the invention, there is provided an image forming apparatus comprising a conveying device which conveys a recording medium; a droplets ejecting device for ejecting droplets onto the recording medium being conveyed by the conveying device; a drying unit for drying the droplets that have been ejected on the recording medium being conveyed by the conveying device; and a varying unit for varying a conveyance path length from the droplets ejecting device to the drying unit in accordance with at least one of a conveyance speed of the recording medium and an ejected droplets permeation characteristic of the recording medium.

Figure 4A:
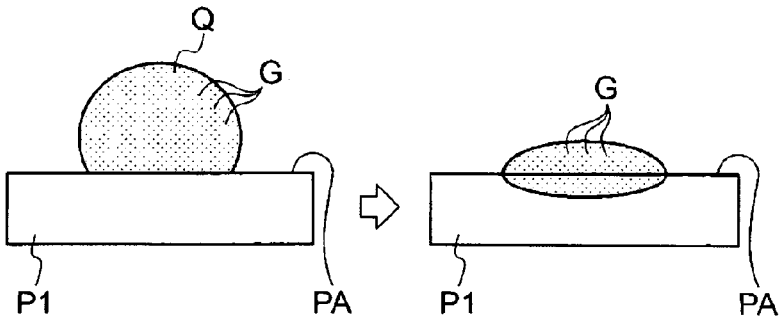
Figure 4B:
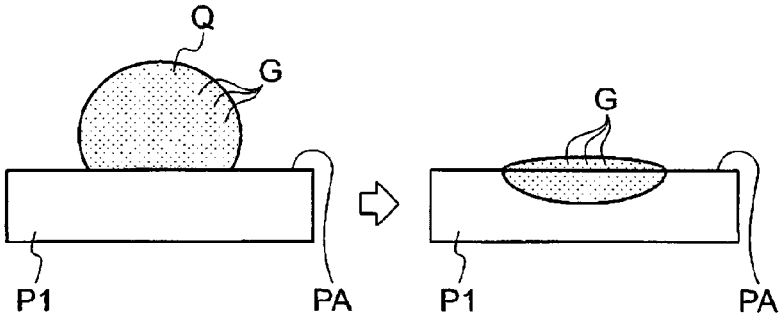
Figure 4C:
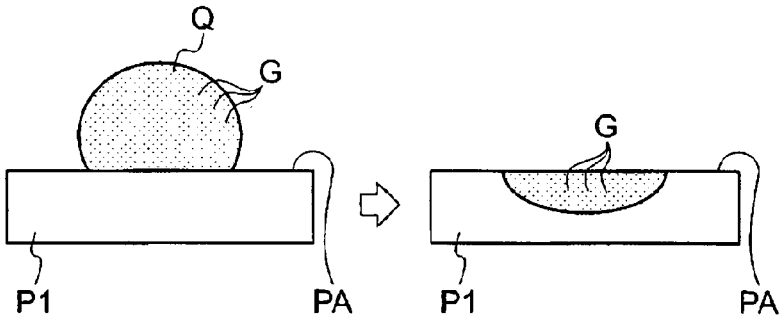

The left part of each of FIGS. 4A, 4B and 4C schematically shows a state immediately after ejecting of a droplet onto a recording medium, and the right part of each of FIGS. 4A, 4B and 4C schematically shows a state that a time has elapsed from the state of the left part and the droplet has permeated into the recording medium; the right parts of 4A, 4B and 4C correspond to cases that the permeation is insufficient, proper, and excessive, respectively.

Figure 5A:
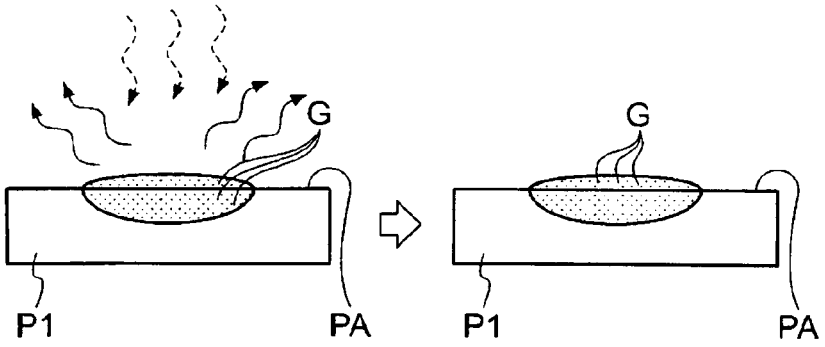
Figure 5B:
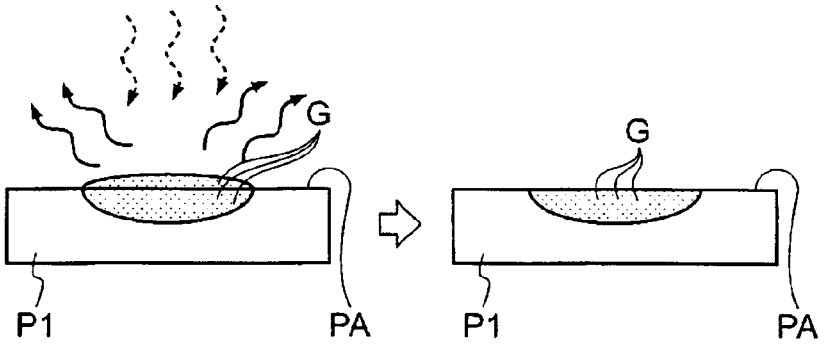
Figure 5C:
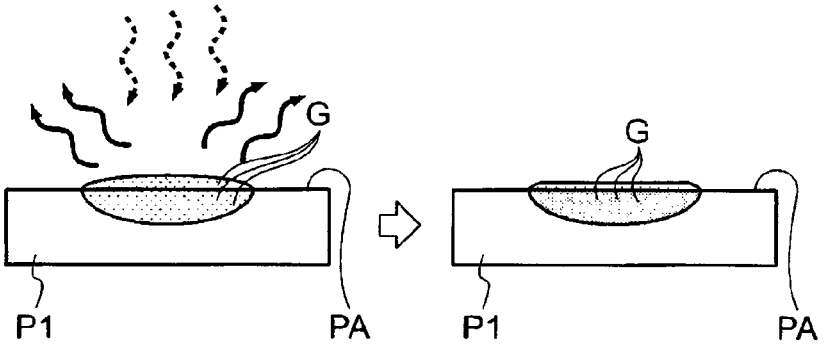

The left part of each of FIGS. 5A, 5B and 5C schematically shows a state that the droplet that has permeated properly into the recording medium (see the right part of FIG. 4B) is being dried by the dryer 60, and the right part of each of FIGS. 5A, 5B and 5C schematically shows a state that a time has elapsed from the state of the left part and the droplet has been dried; the right parts of 5A-5C correspond to cases that the drying is insufficient, proper, and excessive, respectively.

Figure 6:
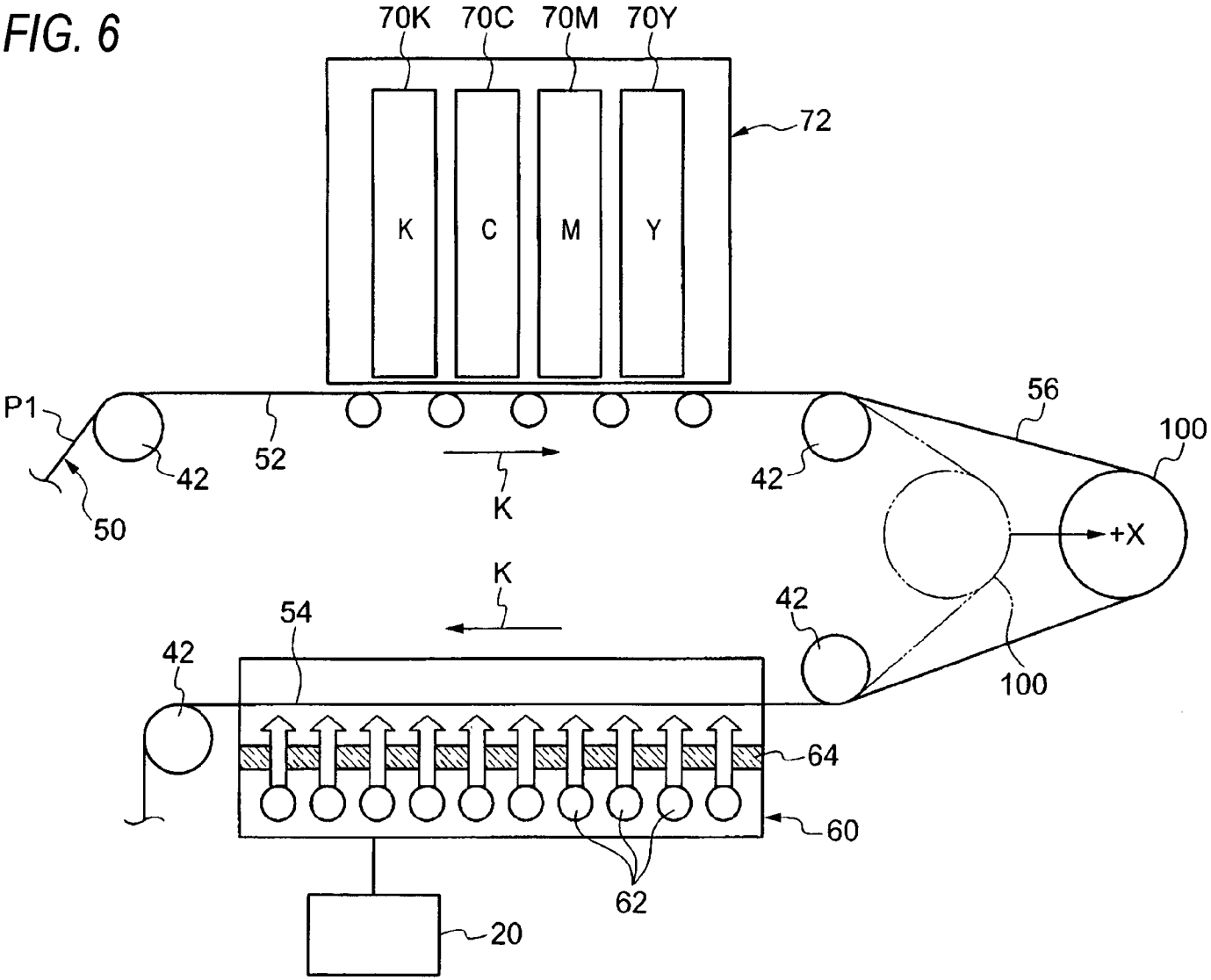

FIG. 6 illustrates a state that the conveyance path length is increased and the output power of infrared heaters is increased when the conveyance speed is high.

Figure 7:
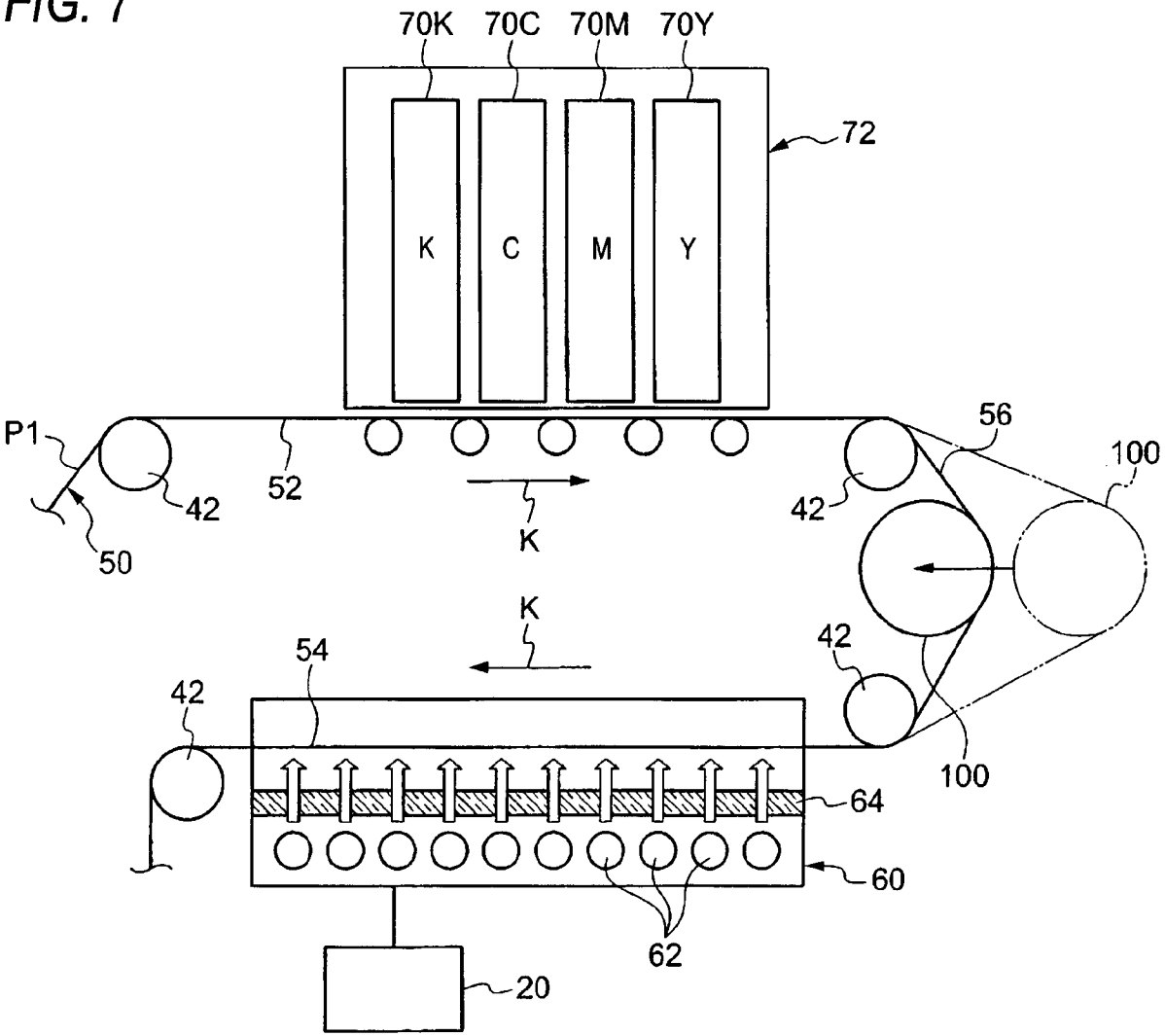

FIG. 7 illustrates a state that the conveyance path length is shortened and the output power of infrared heaters is lowered when the conveyance speed is low.

Figure 8:
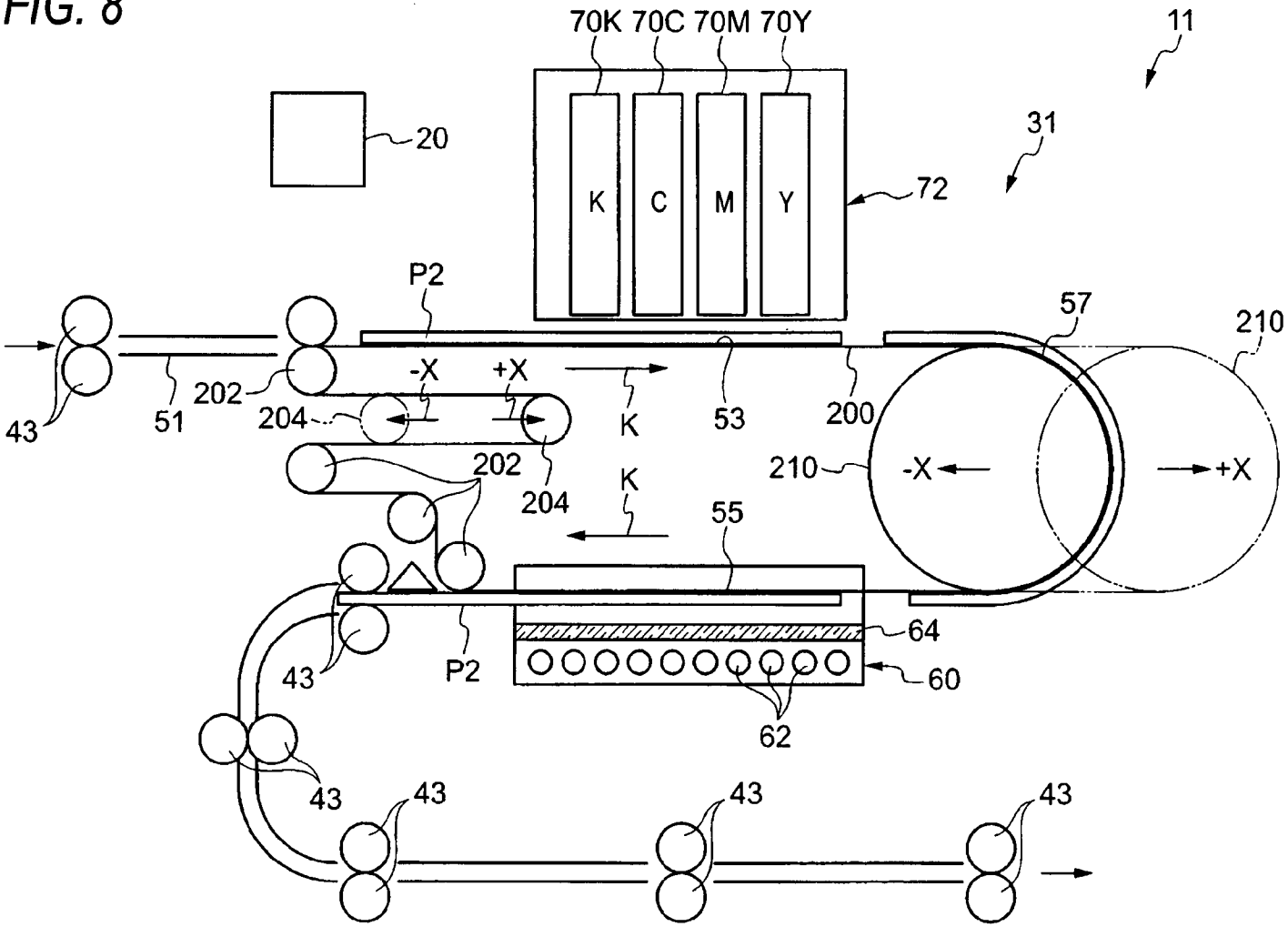

FIG. 8 schematically shows the configuration of an essential part of an image forming unit of an image forming apparatus according to a second exemplary embodiment.

Figure 9:
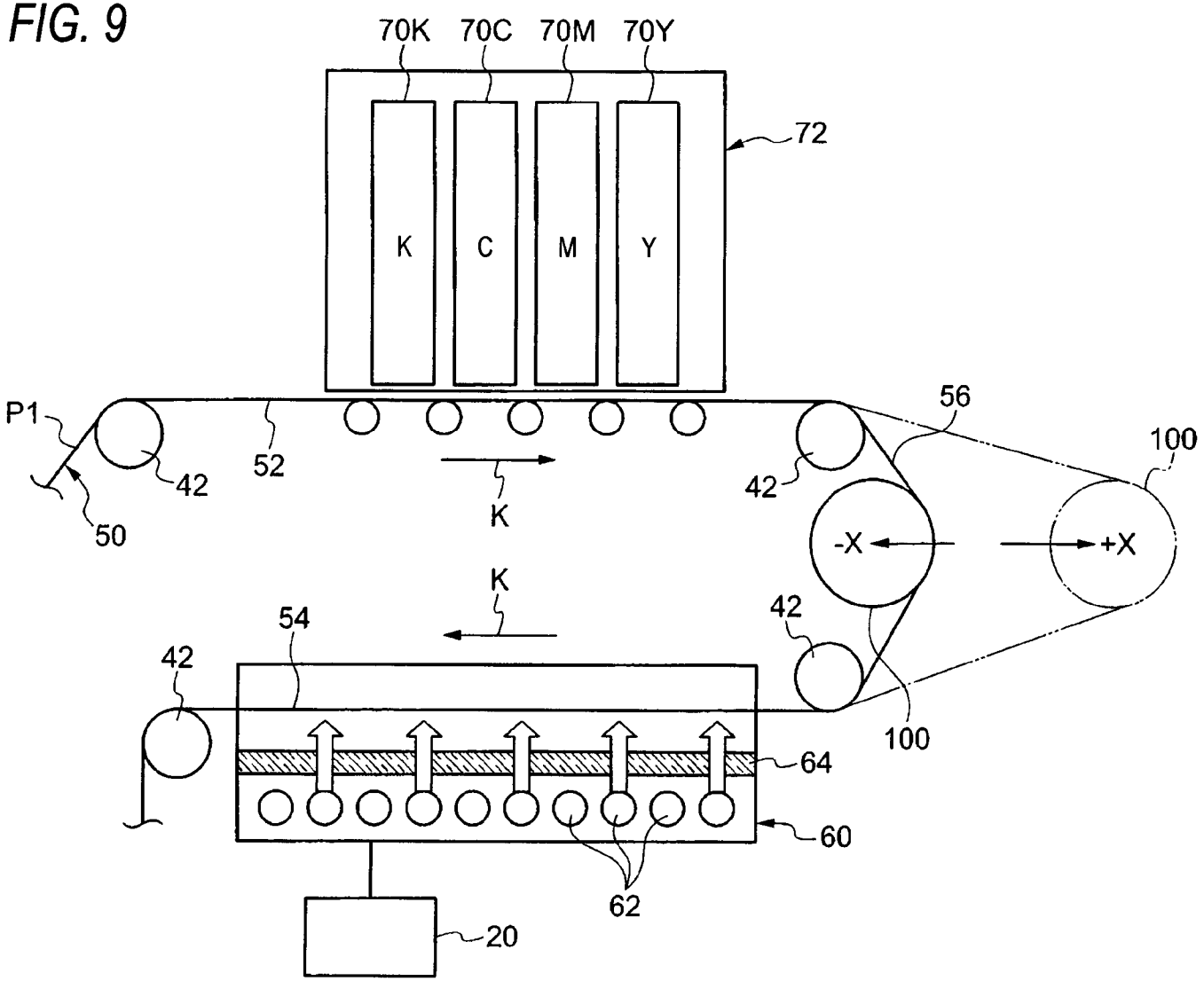

FIG. 9 illustrates a state that the conveyance path length is shortened and the number of turned-on infrared heaters is decreased when the conveyance speed is low (first modification).

Figure 10A:
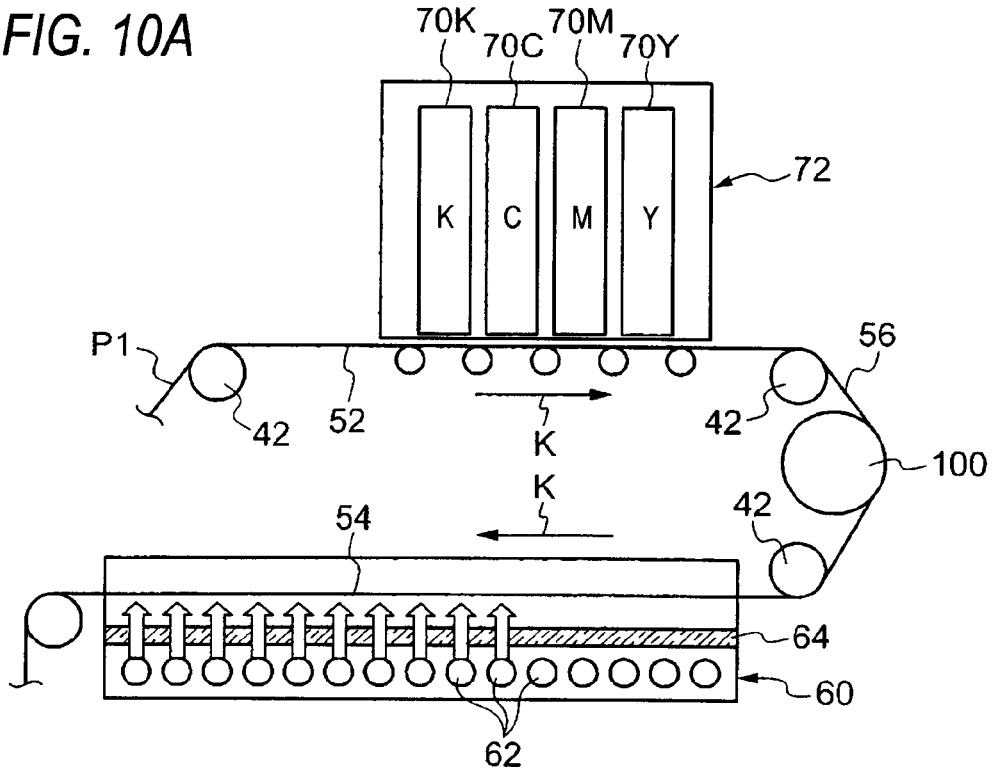
Figure 10B:
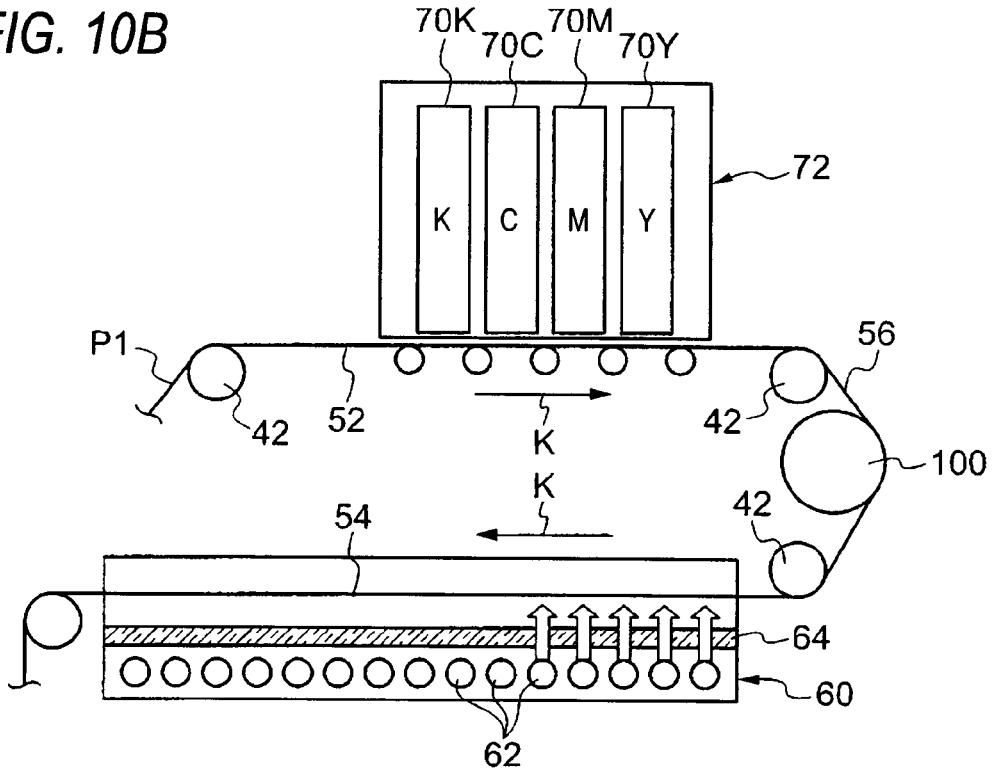

FIG. 10A illustrates a state that the conveyance path length is increased by shifting the turning-on start position of the infrared heaters to the downstream side and the number of turned-on infrared heaters is increased when the conveyance speed is high, and FIG. 10B illustrates a state that the conveyance path length is decreased by shifting the turning-on start position of the infrared heaters to the upstream side and the number of turned-on infrared heaters is decreased when the conveyance speed is low (second modification).

FIG. 11 is a table showing example relationships between droplets permeation characteristics (permeation speeds) and conveyance path lengths of various types of recording media.

DESCRIPTION OF SYMBOLS

10: Image forming apparatus
11: Image forming apparatus
30: Image forming unit (example conveying device)
31: Image forming unit (example conveying device)
60: Dryer (example drying unit)
72: Droplets ejecting device
100: Movable roll (example varying unit)
204: Movable roll (example varying unit)
210: Movable drum (example varying unit)
P1: Continuous paper (example recording medium)
P2: Cut sheet (example recording medium)

DETAILED DESCRIPTION

Exemplary Embodiment 1

An image forming apparatus according to a first exemplary embodiment of the present invention will be described below.

<Overall Configuration>

Figure 1:
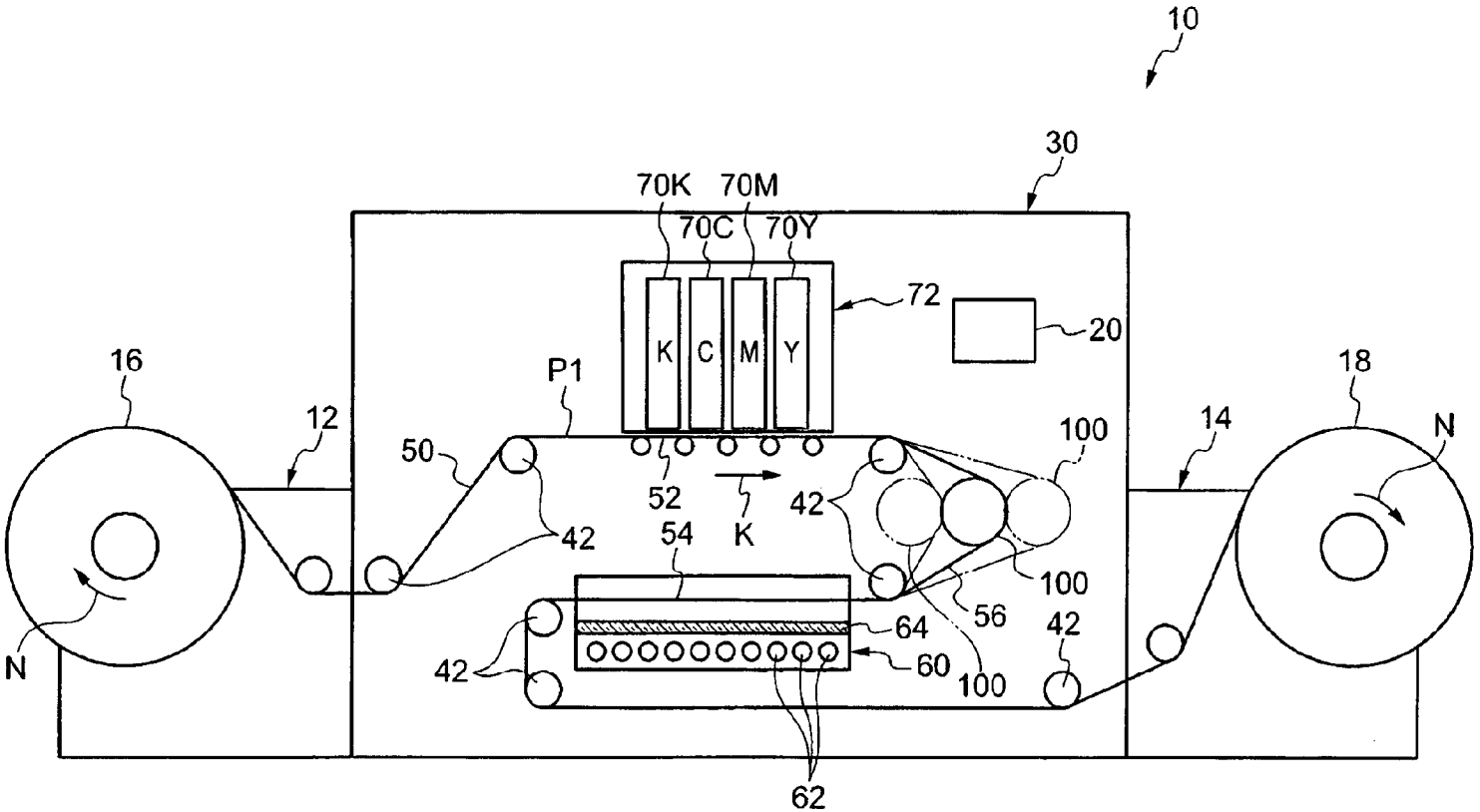
FIG. 1 schematically shows the overall configuration of an image forming apparatus according to a first exemplary embodiment.

First, the overall configuration of the image forming apparatus will be described. The image forming apparatus 10 shown in FIG. 1 is a continuous paper inkjet printer which forms images on continuous paper P1 being conveyed by inkjet printing.

The image forming apparatus 10 is equipped with an image forming unit 30 which forms images on a portion of continuous paper P1, a preprocessing unit 12 which houses a source part of the continuous paper P1 to be supplied to the image forming unit 30, and a post-processing unit 14 which houses an image-formed part of the continuous paper P1 that is ejected from the image forming unit 30.

The image forming unit 30 of the image forming apparatus 10 is equipped with a control unit 20, which performs various controls for the entire image forming apparatus 10. A buffer unit for controlling the conveyance amount etc. of the continuous paper P1 may be disposed between the preprocessing unit 12 and the image forming unit 30 and between the image forming unit 30 and the post-processing unit 14.

The continuous paper P1 is wound on plural conveying rolls 42 and a movable roll 100 and is conveyed along a conveyance path 50 which is formed inside the image forming unit 30. The movable roll 100, which is disposed between a droplets ejecting device 72 and a dryer 60, serves to returns the continuous paper P1. A part, between the droplets ejecting device 72 and the dryer 60, of the conveyance path 50 is called a return path portion 56. As described later, the movable roll 100 is made movable in the left-right direction in FIG. 1 (+X and −X directions indicated by arrows in FIG. 2) by a moving mechanism 150 (see FIGS. 3A and 3B).

The droplets ejecting device 72 is disposed inside the image forming unit 30. The droplets ejecting device 72 has four droplets ejecting heads 70K, 70C, 70M, and 70Y of four colors (black (K), cyan (C), magenta (M), and yellow (Y)) which eject ink droplets onto the continuous paper P1 being conveyed along the conveyance path 50. In the following description, the droplets ejecting heads will be denoted by numeral 70 followed by K, C, M, and Y when they need to be discriminated from each other in terms of color; if not, these suffixes will be omitted.

The droplets ejecting heads 70 of the droplets ejecting device 72 are opposed to an upper flat path portion 52 which is part of the conveyance path 50. The droplets ejecting heads 70K, 70C, 70M, and 70Y are arranged in this order in a continuous paper conveyance direction indicated by arrow K.

Each droplets ejecting head 70 is long in the direction that is perpendicular to the continuous paper conveyance direction K. The image forming area of each droplets ejecting head 70 is set greater than the width of the continuous paper P1.

Each droplets ejecting head 70 is configured so as to be supplied with ink of the corresponding color from an ink tank (not shown). In this exemplary embodiment, water-based pigment inks are used in each of which a pigment G (see FIGS. 4A-4C) is dispersed in a water-based solvent. To attain high image quality, the inks that are slow to permeate are employed in the exemplary embodiment.

There are no limitations on the method by which each droplets ejecting head 70 ejects ink droplets. Any of known techniques of the thermal type, piezoelectric type, etc. can be used.

Inside the image forming unit 30, the dryer 60 (described later) is disposed downstream of (under (see FIGS. 1 and 2)) the droplets ejecting heads 70 in the conveyance direction K.

The preprocessing unit 12 is equipped with a supply roll 16 around which a source part of the continuous paper P1 to be supplied to the image forming unit 30 is wound. The supply roll 16 is supported by a frame member (not shown) so as to be rotatable in the direction indicated by arrow N.

On the other hand, the post-processing unit 14 is equipped with a takeup roll 18 for taking up an image-formed part of the continuous paper P1. As the takeup roll 18 is rotated in the direction indicated by arrow N receiving rotational force from a motor (not shown), the continuous paper P1 is conveyed along the conveyance path 50. The continuous paper conveyance speed can be varied by varying the rotation speed of the motor (not shown). The conveyance speed is in a range of 30 to 200 m/min.

<Image Forming Operation>

Next, an image forming process according to which the image forming apparatus 10 forms images on the continuous paper P1 will be outlined.

The takeup roll 18 of the post-processing unit 14 is rotated, whereby the continuous paper P1 is given tension in the conveyance direction K and thereby conveyed along the conveyance path 50.

The droplets ejecting heads 70 of the respective colors of the droplets ejecting device 72 eject ink droplets Q onto the portion, being conveyed along the upper flat path portion 52, of the continuous paper P1, whereby an image is formed on that portion of the continuous paper P1 (see FIG. 4B).

As a portion of the continuous paper P1 is conveyed along a lower flat path portion 54, the dryer 60 dries the ink droplets, that is, evaporates the water contained therein, and thereby fuses the ink droplets on that portion of the continuous paper P1 (see FIG. 5B).

Since the continuous paper conveyance speed is variable, the control unit 20 adjusts the ink droplets ejecting frequency of each droplets ejecting head 70 in accordance with the conveyance speed. Where the productivity increases as the continuous paper conveyance speed increases, a slow conveyance speed is advantageous in terms of conveyance stability and contributes to increase in image quality. Therefore, the user sets the conveyance speed as appropriate by manipulating a control panel (not shown) according to a purpose of printing.

<Moving Mechanism>

Next, a description will be made of the moving mechanism 150 which is disposed adjacent to the return path portion 56 which is the part, between the droplets ejecting device 72 and the dryer 60, of the conveyance path 50. The moving mechanism 150 moves the movable roll 100 on which the continuous paper P1 is wound.

Figure 2:
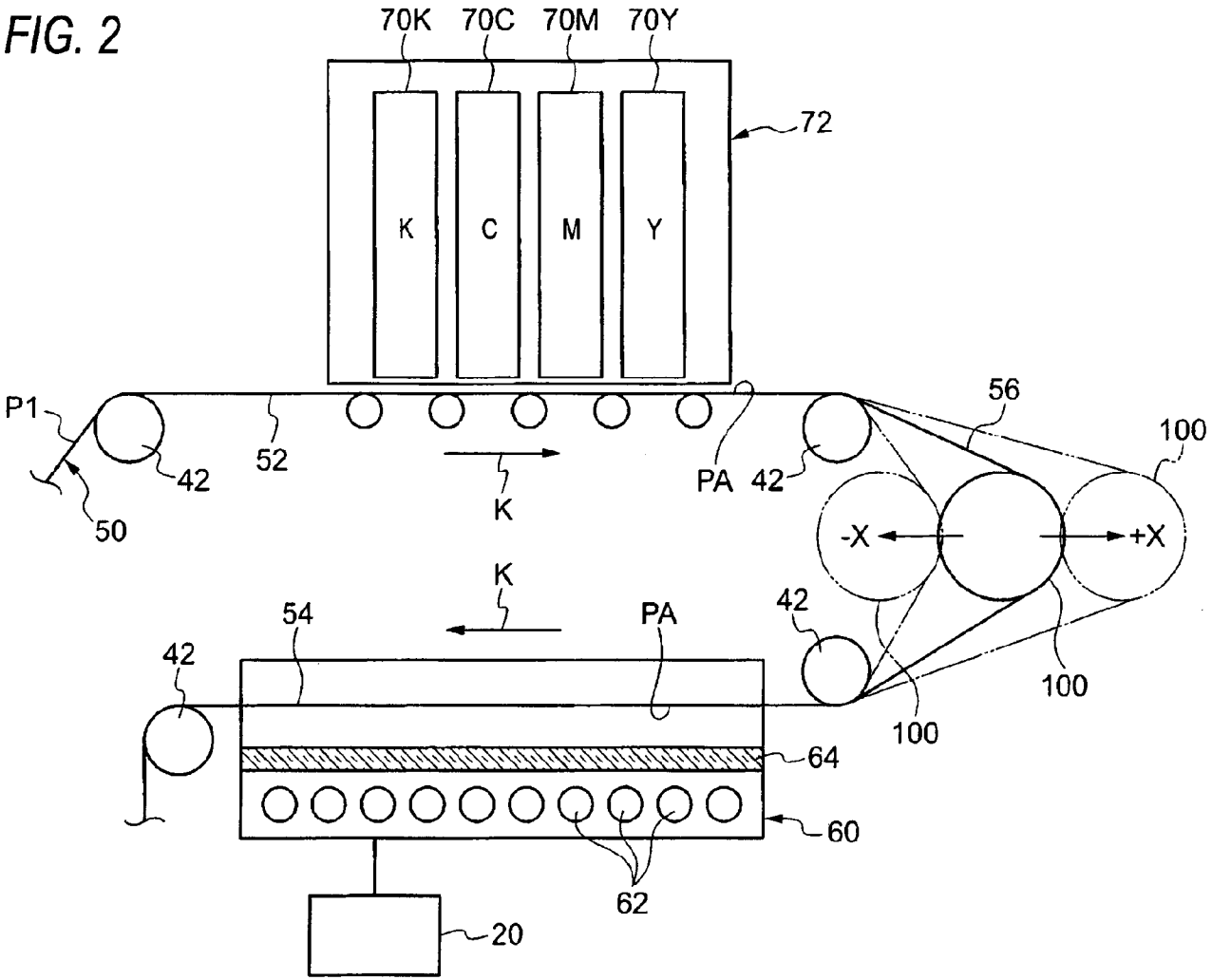
FIG. 2 schematically shows the configuration of an essential part of an image forming unit of the image forming apparatus according to the first exemplary embodiment shown in FIG. 1.
Figure 3A:
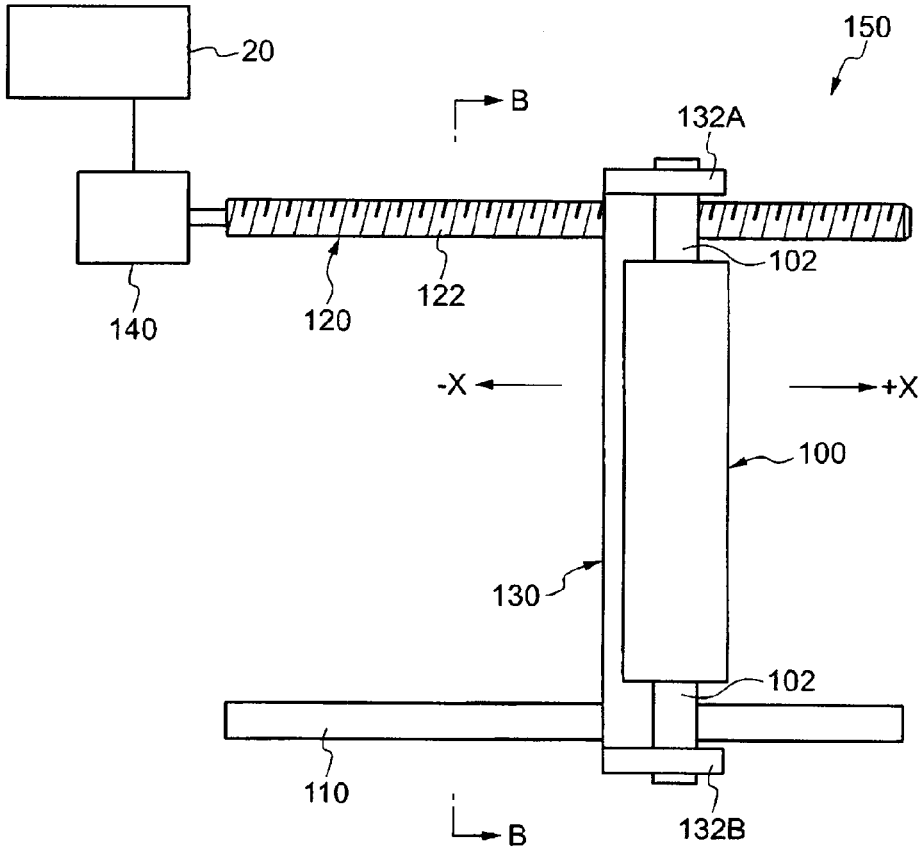
FIG. 3A is a schematic plan view of a moving mechanism.

As shown in FIGS. 2 and 3A, the movable roll 100 is moved in the −X direction (leftward direction in the figures) and the +X direction (rightward direction). In the following description, the movement directions are denoted merely by character X (i.e., the signs "+" and "−" are omitted) when it is not necessary to discriminate between the leftward and rightward directions.

As shown in FIG. 3A, the moving mechanism 150 includes the movable roll 100, a roll support member 130, a shaft 110, a ball screw 120, and a motor 140.

The ball screw 120 includes a screw shaft 122, a nut 124 (see FIG. 3B), and balls (not shown) which are disposed between the ball screw 120 and the nut 124. Thus, the ball screw 120 is a component for converting a rotational movement of the screw shaft 122 into a linear movement of the nut 124. The screw shaft 122 of the ball screw 120 extends in the X direction, is supported rotatably by a body or the like (not shown) at both ends, and is rotated by the motor 140.

The shaft 110 extends in the X direction parallel with the screw shaft 122 of the ball screw 120 and fixed to a body or the like (not shown) at both ends.

Figure 3B:
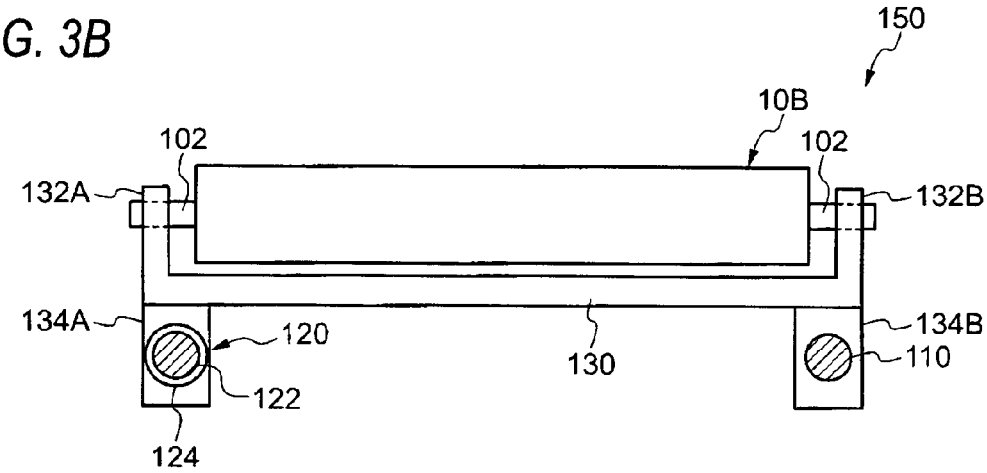
FIG. 3B is a partially sectional (taken along line B-B), side view of the image forming unit shown in FIG. 3A.

As shown in FIG. 3B, the roll support member 130 is configured in such a manner that upper support portions 132A and 132B which project upward and lower support portions 134A and 134B which project downward. A rotary shaft 132 of the movable roll 100 is supported rotatably by the upper support portions 132A and 132B.

As shown in FIG. 3B, the screw shaft 122 of the ball screw 120 penetrates through the one lower support portion 134A of the roll support member 130 and the nut 124 of the ball screw 120 is fixed to the one lower support portion 134A. The shaft 110 penetrates through the other lower support portion 134B.

When the motor 140 (see FIG. 3A) is driven and the screw shaft 122 of the ball screw 120 is thereby rotated, the roll support member 130 to which the nut 124 (see FIG. 3B) is fixed and the movable roll 100 which is supported rotatably by the roll support member 130 are moved in the −X direction or the +X direction.

As shown in FIG. 2, when the movable roll 100 is moved in the X direction, the conveyance path length of the return path portion 56 which is the part, between the droplets ejecting device 72 and the dryer 60, of the conveyance path 50 is varied. More specifically, the conveyance path length of the return path portion 56 is increased when the movable roll 100 is moved in the +X direction, and is shortened when the movable roll 100 is moved in the −X direction.

The motor 140 (see FIG. 3A) is controlled by the control unit 20. That is, the control unit 20 performs a control of varying the conveyance path length of the return path portion 56 between the droplets ejecting device 72 and the dryer 60.

<Dryer>

Next, the dryer 60 will be described. As shown in FIG. 2, the dryer 60 dries ink droplets ejected on the continuous paper P1, that is, evaporates the water contained therein (see FIG. 5B), by radiation heating using plural infrared heaters 62. The continuous paper P1 and the infrared heaters 62 are separated by a glass plate 64 which is opposed to the lower flat path portion 54 which is part of the conveyance path 50.

The output power of the infrared heaters 62 is variable and controlled by the control unit 20. FIG. 6 shows a state corresponding to a case that the output power of the infrared heaters 62 is high. FIG. 7 shows a state corresponding to a case that the output power of the infrared heaters 62 is low.

The infrared heaters 62 is cooled by a fan (not shown), and high-humidity air that is produced by evaporation of water from ink droplets is discharged by a ventilator (not shown).

<Workings>

Next, a description will be made of how the image forming apparatus 10 according to the exemplary embodiment works.

(Relationship between Image and the Degree of Permeation of Ink Droplets into Continuous Paper)

The left part of each of FIGS. 4A-4C schematically shows a state immediately after ejecting of a droplet Q onto the continuous paper P1. The right part of each of FIGS. 4A-4C schematically shows a state that a time has elapsed from the state of the left part and the droplet Q has permeated into the continuous paper P1. The elapsed time (permeation time) increases in the order from FIG. 4A to FIG. 4C.

The right part of FIG. 4B schematically shows a case that the permeation of the ink droplet Q into the continuous paper P1 is proper for its drying by the dryer 60 (see FIG. 2). A fine image can be obtained if ink droplets being in such a proper permeation state are dried by the dryer 60.

On the other hand, in the case where as shown in the right part of FIG. 4A the permeation of the ink droplet Q into the continuous paper P1 is insufficient because of too short a permeation time, a large amount of ink remains on the surface PA of the continuous paper P1, that is, a large amount of pigment particles G exist in the ink remaining on the surface PA. Therefore, even after the drying by the dryer 60, the fusing of the pigment particles G on the continuous paper P1 becomes insufficient, as a result of which the pigment particles G are prone to offsetting and smudging.

In the case where as shown in the right part of FIG. 4C the permeation of the ink droplet Q into the continuous paper P1 is excessive because of too long a permeation time, only a small amount of ink remains on the surface PA of the continuous paper P1, that is, only a small amount of pigment particles G exist in the ink remaining on the surface PA. As a result, the density of a resulting image tends to become too low.

(Relationship between Image and Drying)

The left part of each of FIGS. 5A-5C schematically shows a state that the droplet Q that has permeated properly into the continuous paper P1 (see the right part of FIG. 4B) is being dried by the dryer 60. The right part of each of FIGS. 5A-5C schematically shows a state that a time has elapsed from the state of the left part and the droplet Q has been dried. The elapsed time (drying time), that is, the drying energy, increases in the order from FIG. 5A to FIG. 5C.

A fine image is obtained if ink droplets are dried properly as shown in FIG. 5B.

On the other hand, in the case where as shown in the right part of FIG. 5A the drying time is too short (the drying energy is insufficient), the evaporation of water from droplets is insufficient and they are not dried completely, to possibly cause offsetting or smudging.

In the case where as shown in the right part of FIG. 5C the drying time is too long (the drying energy is excessive), the evaporation of water from droplets is excessive and a large amount of pigment particles G remain on the surface PA. Therefore, the fusing of the pigment particles G on the continuous paper P1 becomes insufficient, as a result of which the pigment particles G are prone to offsetting and smudging.

(Control of Varying the Conveyance Path Length from Droplets Ejecting Device to Dryer)

As shown in FIG. 2 etc., ink droplets Q that have been ejected on the continuous paper P1 by the droplets ejecting device 72 (see the left parts of FIGS. 4A-4C) permeate into the continuous paper P1 (see the right parts of FIGS. 4A-4C) while being conveyed along the return path portion 56 and then dried by the dryer 60 (see the right parts of FIGS. 5A-5C).

In the image forming apparatus 10 according to the exemplary embodiment, the continuous paper conveyance speed is variable. Therefore, if the conveyance path length of the return path portion 56 were fixed, the time taken by ink droplets to pass the return path portion 56 would vary depending on the conveyance speed. Therefore, the ink droplets permeation time, and hence the degree of permeation, would vary depending on the continuous paper conveyance speed. That is, the permeation might would become insufficient (right part of FIG. 4A) or excessive (left part of FIG. 4C), to cause an image failure such as offsetting or smudging of pigment particles G or density reduction.

In view of the above, in the exemplary embodiment, the control unit 20 moves the movable roll 100 in the X direction using the moving mechanism 150 shown in FIGS. 3A and 3B and thereby varies the conveyance path length of the return path portion 56 so that the ink droplets permeation time falls within a predetermined range, that is, ink droplets Q being in the state shown in the right part of FIG. 4B are dried by the dryer 60.

More specifically, as shown in FIG. 6, when the continuous paper conveyance speed is high, the control unit 20 moves the movable roll 100 in the +X direction and thereby increases the conveyance path length of the return path portion 56. As shown in FIG. 7, when the continuous paper conveyance speed is low, the control unit 20 moves the movable roll 100 in the −X direction and thereby shortens the conveyance path length of the return path portion 56.

As a result, the ink droplets permeation time falls within the predetermined range, that is, the degree of permeation of ink droplets Q falls within an allowable range, irrespective of the continuous paper conveyance speed. Thus, the occurrence of an image failure (e.g., offsetting or smudging of pigment particles G or image density reduction) that may occur because the permeation of ink droplets Q into the continuous paper P1 is improper when they are dried by the dryer 60 can be suppressed.

Furthermore, in the exemplary embodiment, the control unit 20 controls the output power of the infrared heaters 62 of the dryer 60 so that the drying energy that the continuous paper P1 receives in the dryer 60 falls within a predetermined range.

More specifically, as shown in FIG. 6, when the continuous paper conveyance speed is high, the control unit 20 increases the output power of the infrared heaters 62 of the dryer 60. As shown in FIG. 7, when the continuous paper conveyance speed is low, the control unit 20 lowers the output power of the infrared heaters 62 of the dryer 60. In FIGS. 6 and 7, the size of arrows that originate from the infrared heaters 62 represents the magnitude of their output power.

As a result, the drying energy that the continuous paper P1 receives in the dryer 60 falls within the predetermined range and hence the degree of drying of ink droplets does not vary much irrespective of the continuous paper conveyance speed. Thus, the occurrence of an image failure due to improper drying of ink droplets can be suppressed.

Embodiment 2

An image forming apparatus according to a second exemplary embodiment of the invention will be described below. Components having the same ones in the first exemplary embodiment will be given the same reference symbols as the latter, and will not be described redundantly.

<Overall Configuration>

The image forming apparatus 11 shown in FIG. 8 is a sheet-fed printer which forms images on cut sheets P2 being conveyed by inkjet printing.

The image forming apparatus 11 is equipped with an image forming unit 31 which forms images on cut sheets P2, a preprocessing unit (not shown) which houses cut sheets P2 to be supplied to the image forming unit 31, and a post-processing unit (not shown) which houses cut sheets P2 that are ejected from the image forming unit 31. The image forming unit 31 of the image forming apparatus 11 is equipped with a control unit 20, which performs various controls for the entire image forming apparatus 11.

A cut sheet P2 is conveyed by plural conveying rolls 43 and a conveying belt 200 along a conveyance path 51 which is formed inside the image forming unit 31.

Droplets ejecting heads 70 of a droplets ejecting device 72 are opposed to an upper flat path portion 53, that is, an upper flat portion of the conveying belt 200. Inside the image forming unit 31, a dryer 60 is disposed downstream of (under (see FIG. 10)) the droplets ejecting heads 70 in a conveyance direction K. The dryer 60 is opposed to a lower flat path portion 55, that is, a lower flat portion of the conveying belt 200.

A cut sheet P2 is conveyed as the conveying belt 200 is moved in the conveyance direction K receiving rotational force from a motor (not shown) in a state that the cut sheet P2 is stuck to it as a result of operation of a sticking means (not shown). The conveyance speed of a cut sheet P2 being conveyed by the conveying belt 200 can be varied by varying the movement speed of the conveying belt 200 by varying the rotation speed of the motor (not shown).

<Conveying Belt Moving Mechanism>

Next, a description will be made of a conveying belt moving mechanism 150. The conveying belt 200 is wound on plural rolls 202, a movable roll 204, and a movable drum 210. The movable roll 204 and the movable drum 210 are moved in an X direction by a mechanism with a ball screw which is similar to the moving mechanism 150 used in the first embodiment (see FIGS. 3A and 3B).

When the movable roll 204 and the movable drum 210 are moved in the X direction, the conveyance path length of a return path portion 57 which is a part, between the droplets ejecting device 72 and the dryer 60, of the conveyance path 51 is varied. More specifically, the conveyance path length of the return path portion 57 is increased when the movable drum 210 is moved in the +X direction and the movable roll 204 is moved in the −X direction accordingly. The conveyance path length of the return path portion 57 is shortened when the movable drum 210 is moved in the −X direction and the movable roll 204 is moved in the +X direction accordingly.

The movable drum 210 and the movable roll 204 are controlled by the control unit 20. That is, the control unit 20 performs a control of varying the conveyance path length of the return path portion 57 between the droplets ejecting device 72 and the dryer 60.

<Workings>

Next, a description will be made of how the image forming apparatus 11 according to the exemplary embodiment works.

In this exemplary embodiment, as in the first exemplary embodiment, the control unit 20 moves the movable drum 210 and the movable roll 204 in the X direction and thereby varies the conveyance path length of the return path portion 57 so that the time during which ink droplets permeate into a cut sheet P2 falls within a predetermined range.

More specifically, when the conveyance speed is high, the control unit 20 moves the movable drum 210 in the +X direction and thereby increases the conveyance path length of the return path portion 57. When the conveyance speed is low, the control unit 20 moves the movable drum 210 in the −X direction and thereby shortens the conveyance path length of the return path portion 57.

As a result, the ink droplets permeation time falls within the predetermined range, that is, the degree of permeation of ink droplets Q falls within an allowable range, irrespective of the cut sheet conveyance speed. Thus, the occurrence of an image failure (e.g., offsetting or smudging of pigment particles G or image density reduction) that may occur because the permeation of ink droplets Q into a cut sheet P2 is improper when they are dried by the dryer 60 can be suppressed.

Furthermore, in this exemplary embodiment, as in the first exemplary embodiment, the control unit 20 controls the output power of infrared heaters 62 of the dryer 60 so that the drying energy that a cut sheet P2 receives in the dryer 60 falls within a predetermined range.

More specifically, when the cut sheet conveyance speed is high, the control unit 20 increases the output power of the infrared heaters 62 of the dryer 60. When the cut sheet conveyance speed is low, the control unit 20 lowers the output power of the infrared heaters 62 of the dryer 60. As a result, the drying energy falls within the predetermined range and hence the degree of drying of ink droplets does not vary much, whereby the occurrence of an image failure due to improper drying of ink droplets can be suppressed.

<Modifications>

Next, modifications of the exemplary embodiments will be described below. Although the modifications will be described using the drawings (FIGS. 1 and 2 etc.) corresponding to the image forming apparatus 10 according to the first exemplary embodiment, the concepts of the modifications are likewise applicable to the image forming apparatus 11 according to the second exemplary embodiment (see FIG. 7).

(Modification 1)

In the exemplary embodiments, the drying energy that continuous paper P1 (or cut sheet P2) receives is set within the predetermined range by adjusting the output power of all the infrared heaters 62 (see FIGS. 6 and 7) in accordance with the conveyance speed of the continuous paper P1 (or cut sheet P2). However, the invention is not limited to such a case.

For example, as in a first modification shown in FIG. 9, the drying energy that continuous paper P1 (or cut sheet P2) receives may be set within the predetermined range by varying the number of turned-on infrared heaters 62 in accordance with the conveyance speed of the continuous paper P1 (or cut sheet P2). That is, the number of turned-on infrared heaters 62 is increased when the conveyance speed is high, and is decreased when the conveyance speed is low.

Alternatively, the drying energy that continuous paper P1 (or cut sheet P2) receives may be set within the predetermined range by varying both of the output power of the infrared heaters 62 and the number of turned-on infrared heaters 62 in accordance with its conveyance speed.

(Modification 2)

In the exemplary embodiments, the conveyance path length of the return path portion 56 (or 57) is varied by moving the movable roll 100 (or movable drum 210) as shown in FIGS. 2 and 3A so that the permeation time falls within the predetermined range. However, the invention is not limited to such a case.

For example, as in a second modification shown in FIG. 10A, the conveyance path length may be increased by shifting, to the downstream side, the turning-on start position (drying start position) of the infrared heaters 62, that is, the position of the upstream end infrared heater 62 of turned-on infrared heaters 62, in accordance with the conveyance speed of continuous paper P1 (or cut sheet P2). The number of turned-on infrared heaters 62 is increased at the same time. As shown in FIG. 10B, the conveyance path length may be shortened by shifting, to the upstream side, the turning-on start position (drying start position) of the infrared heaters 62, that is, the position of the upstream end infrared heater 62 of turned-on infrared heaters 62, in accordance with the conveyance speed of continuous paper P1 (or cut sheet P2). The number of turned-on infrared heaters 62 is decreased at the same time.

In this configuration, the movable roll 100 (or movable drum 210) is not moved (i.e., its position is fixed).

Alternatively, the conveyance path length may be varied by using both of the movement of the movable roll 100 (or movable drum 210) and the turning-on start position (drying start position) of the infrared heaters 62.

Still further, the drying energy that continuous paper P1 (or cut sheet P2) receives may be set within the predetermined range by varying both of the output power of the infrared heaters 62 and the number of turned-on infrared heaters 62.

<Other Modifications>

In the above-described exemplary embodiments and modifications, the conveyance path length from the droplets ejecting device 72 to the dryer 60 is varied in accordance with the conveyance speed of the recording medium (continuous paper P1 or cut sheet P2) so that the permeation time falls within a predetermined range (i.e., ink droplets being in the state shown in the right part of FIG. 4B are dried by the dryer 60). However, the invention is not limited to such a case.

The droplets (ink droplets) permeation speed varies depending on the permeation characteristic of the recording medium (continuous paper P1 or cut sheet P2), that is, the type of recording medium. In the case of a recording medium (continuous paper P1 or cut sheet P2) having a permeation characteristic that the permeation speed is low, a large amount of ink tends to remain on the surface of the recording medium as in the case that the permeation time is so short that the permeation becomes insufficient (see the right part of FIG. 9A), as a result of which pigment particles G are prone to offsetting and smudging.

In the case of a recording medium (continuous paper P1 or cut sheet P2) having a permeation characteristic that the permeation speed is high, only a small amount of ink tends to remain on the surface of the recording medium as in the case that the permeation time is so long that the permeation becomes excessive (see the right part of FIG. 4C), as a result of which the image density is prone to become low.

In view of the above, the conveyance path length from the droplets ejecting device 72 to the dryer 60 may be varied in accordance with the droplets permeation characteristic of the recording medium (continuous paper P1 or cut sheet P2). In this case, conveyance path lengths that are suitable for types of recording media (continuous paper P1 or cut sheets P2), that is, permeation characteristics of recording media, are determined in advance by experiments, for example, and stored in a storage means of the control unit 20 in advance. FIG. 11 is a table showing example relationships between droplets permeation characteristics (permeation speeds) and conveyance path lengths of various types of recording media.

The user selects a type of recording medium such as continuous paper P1 or a cut sheet P2 (i.e., a permeation characteristic (permeation speed)) by manipulating a control panel (not shown). Based on the selection result, the control unit 20 varies the conveyance path length by moving the movable roll 100 or the movable drum 210 in the X direction. More specifically, the conveyance path length is increased when the droplets permeation speed of the recording medium (continuous paper P1 or cut sheet P2) is low, and is shortened when the droplets permeation speed is high.

The conveyance path length may be varied in accordance with both of the conveyance speed and the droplets permeation speed of the recording medium (continuous paper P1 or cut sheet P2).

In the above-described exemplary embodiments and modifications, droplets (ink droplets) ejected on continuous paper P1 or a cut sheet P2 are dried by evaporating water from them by radiation heating using the plural infrared heaters 62, the invention is not limited to such a case. A dryer (drying means) having any configuration may be employed as long as it has the function of drying droplets (ink droplets) by evaporating water from them.

The configuration of the image forming apparatus is not limited to the configurations described in the exemplary embodiments and the modifications but various other configurations may be employed. Furthermore, it goes without saying that the invention can be practiced in various forms without departing from the spirit and scope of the invention.

What is claimed is:

1. An image forming apparatus comprising:

a conveying device that conveys a recording medium in a conveyance direction;

a droplets ejecting device that ejects droplets onto the recording medium being conveyed by the conveying device;

a drying unit that dries the droplets that have been ejected on the recording medium being conveyed by the conveying device, the drying unit comprising a plurality of infrared heaters arranged in the conveyance direction; and a varying unit that varies a conveyance path length from the droplets ejecting device to the drying unit in accordance with at least one of a conveyance speed of the recording medium and an ejected droplets permeation characteristic of the recording medium, wherein the varying unit varies the conveyance path length by varying a drying start position, on an upstream side in the conveyance direction, in a drying area of the drying unit by selecting at least one of the plurality of infrared heaters to be turned on.

2. The image forming apparatus according to claim 1, wherein the drying unit adjusts an output power of the drying unit in accordance with the conveyance speed of the recording medium.

* * * * *